United States Patent [19]

Giovine

[11] Patent Number: 4,879,442

[45] Date of Patent: Nov. 7, 1989

[54] TISSUE CONTAINER AND WASTE TISSUE RECEPTACLE

[76] Inventor: Robert L. Giovine, 665 Bancroft Rd., Brick Town, N.J. 08723

[21] Appl. No.: 234,925

[22] Filed: Aug. 22, 1988

[51] Int. Cl.[4] ..... B65D 69/00

[52] U.S. Cl. ..... 206/233; 206/494

[58] Field of Search ..... 206/233, 494, 812; 220/20

[56] References Cited

U.S. PATENT DOCUMENTS

| | | | |
|---|---|---|---|
| 2,841,275 | 7/1958 | Schwimmer et al. | 206/233 |
| 3,026,999 | 3/1962 | Constantino . | |
| 3,072,245 | 1/1963 | Faltin . | |
| 3,089,597 | 5/1963 | Kaplan . | |
| 3,331,498 | 7/1967 | Davies | 206/494 |
| 3,414,157 | 12/1968 | Wright . | |
| 3,458,095 | 7/1969 | Stall . | |
| 3,913,810 | 10/1975 | Shaw . | |
| 4,483,440 | 11/1984 | Ware | 206/233 |

*Primary Examiner*—Stephen M. Hepperle

[57] ABSTRACT

A receptacle for the selective removal of tissue and the storage of soiled tissue comprising a container having a first opening and a second opening, said openings being disposed in opposite walls of the container, a movable partition positioned within said container, fresh clean tissues positioned between said movable partition and one of said openings and a waste receptacle positioned between said movable partition and said second opening, the waste receptacle positioned to expand to receive soiled tissues as fresh tissues are selectively removed from the first opening and thence deposited through the second opening into the waste receptacle.

1 Claim, 2 Drawing Sheets

TISSUE CONTAINER AND WASTE TISSUE RECEPTACLE

FIELD OF INVENTION

This invention relates to a tissue container and waste receptacle and, more particularly, to a tissue box which will have a waste receptacle for soiled tissues incorporated therein.

BACKGROUND OF THE INVENTION

Standard tissue boxes have been in use for a substantial period of time. They are used by individuals in their homes and automobiles and other locations. When used in the homes, the soiled tissues are readily disposable in a wastebasket which is normally easily accessible. However, when the tissue box is utilized either in a vehicle or in outdoors, a waste receptacle for the soiled tissues is not normally readily available. Various attempts have been made in the past to provide for a convenient waste receptacle for soiled tissues removed from the tissue box when a convenient waste receptacle is not available. U.S. Pat. No. 2,887,216 to Hargraves provided for a method of mounting the tissue box with a separate and distinct waste receptacle hung below the tissue box. This was designed for mounting on the dashboard of a car. Similarly, Shaw in U.S. Pat. No. 3,913,810 attempted to incorporate a tissue dispenser with a disposal bag for mounting on the seat of a vehicle.

Stahl, in U.S. Pat. No. 3,458,095 provided for a mount on the floor of an automobile providing a mount for the tissue box and a mount for a separate waste container.

Wright, in U.S. Pat. No. 3,414,157 provided for a mount and container which incorporated a tissue box in the lid of the container and the lid could be rotated upwardly to provide for a waste receptacle.

Kaplan, in U.S. Pat. No. 3,089,597 also provided for a mount for a standard tissue box with a waste receptacle bag disposed beneath the mount.

Faltin, in U.S. Pat. No. 3,072,245 also provided a mount for the tissue box with a waste receptacle.

Constantino, in U.S. Pat. No. 3,072,999 provided for a visor mounted tissue container with waste receptacle for mounting on the sun visor of a vehicle. Constantino's container and receptacle was of a design distinct from the standard tissue box in order to facilitate mounting on the sun visor.

Applicant's invention relates to a tissue box that provides for the removal of tissue and provides for the waste receptacle to be incorporated within the tissue box, the waste receptacle expanding to accommodate soiled tissue as the amount of fresh tissues is depleted through use. Applicant's invention is disclosed with respect to a standardized tissue box, but would have application to any portable dispenser, dispensing disposable tissue such as for example, pre-moistened towelettes.

OBJECTS OF THE INVENTION

The object of the present invention is to provide a novel tissue box or tissue container which incorporates within the tissue box, a waste receptacle for the soiled tissues removed from the tissue box.

Another object of the present invention is to provide a novel tissue box which permits the waste receptacle area of the tissue box to expand as the fresh tissue supply from the tissue box is depleted.

Another object of the present invention is to provide a novel tissue box which is easily transportable and which provides a waste receptacle for the soiled tissues when no other convenient waste receptacle is available yet does not contaminate the fresh tissues.

SUMMARY OF THE INVENTION

The instant invention comprises a standard tissue box having an aperture on one surface for the selective removal of fresh tissue. The opposing surface also contains an aperture and has affixed thereto, a plastic bag or waste receptacle having a slit coincident with the aperture, the plastic bag being positioned within the tissue box, the plastic bag and fresh tissues being separated by a movable partition substantially parallel with the aperture surfaces such that as fresh tissues are removed from one aperture and soiled; they may be disposed of through the other aperture into the plastic waste receptacle without contaminating the fresh tissues remaining in the box.

BRIEF DESCRIPTION OF THE DRAWINGS

These and other objects of the present invention will become manifest when considered with the accompanying drawings wherein.

DETAILED DESCRIPTION OF THE DRAWINGS

Figure 3:
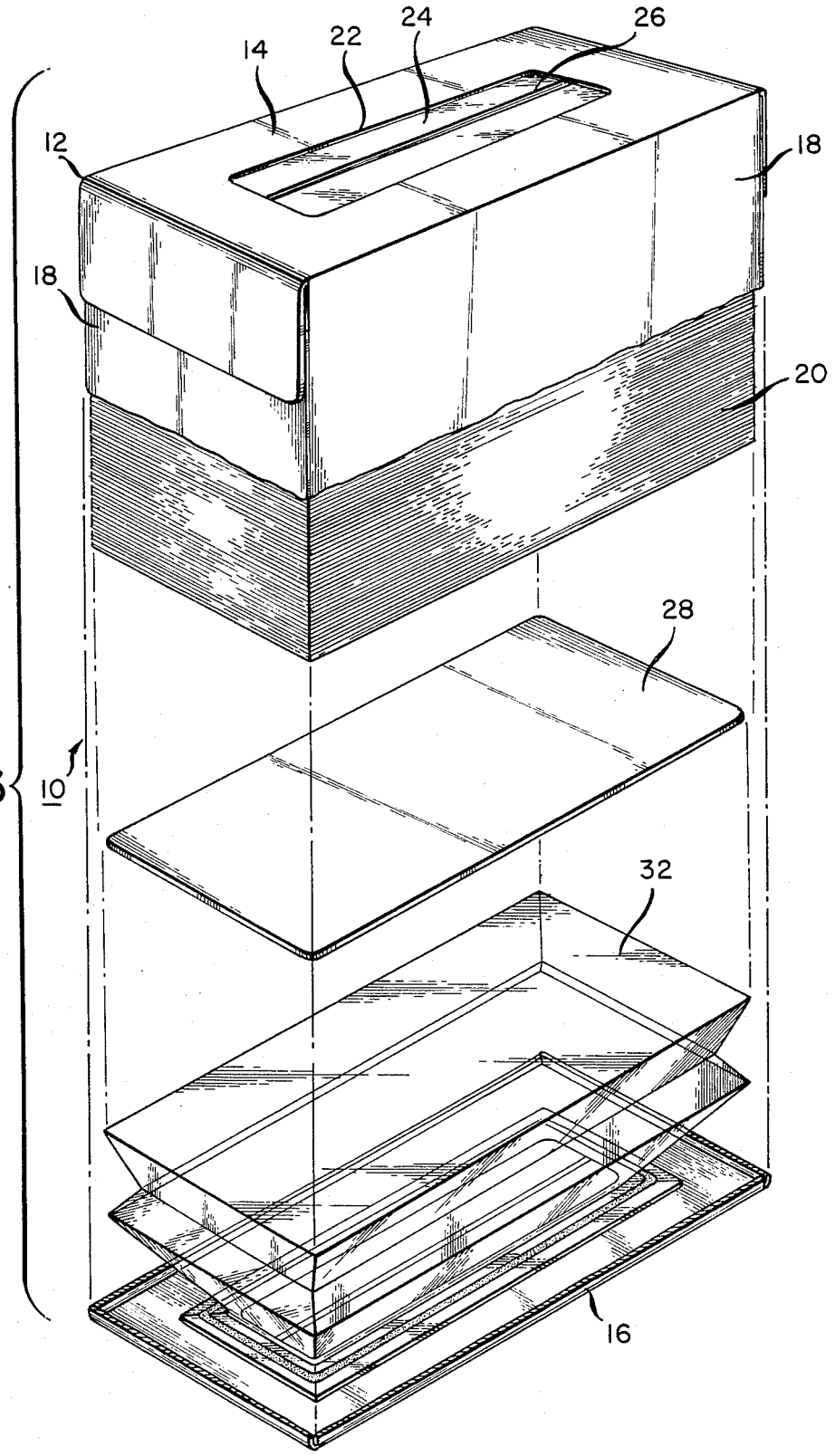
FIG. 3 is an exploded view of the tissue box and waste receptacle.

Referring to FIG. 3, there is shown an exploded view of tissue box 10 which is the subject matter of the present invention. Tissue box 10 comprises a container element 12 having a top surface 14, a bottom surface 16, and a plurality of circumferential sidewalls 18. In this view, bottom surface 16 is shown separately and distinctly from upper surface 14 and circumferential sidewalls 18 for the purpose of clarity. However, bottom surface 16 is secured to circumferential sidewalls 18 in the actual construction of the tissue box 12.

Tissue container 12 contains a plurality of folded fresh tissues 20 which substantially conform to the dimensions of tissue container 12. Tissues 20 are positioned within tissue container 12 such that they can be selectively extracted through aperture 22 in upper surface 14 of tissue container 12. Aperture 22 can be of a variety of shapes but most often is oval in cross section area and, in many instances, has a plastic flap 24 secured to the underside of aperture 22, plastic flap 24 having a longitudinal slit for the extraction of fresh tissues and to prevent contamination of those fresh tissues remaining in tissue container 12. As is normal practice, the tissues 20 are folded in interlock such that when one tissue is extracted through aperture 22, another tissue is raised into aperture 22 or slit 26 so that the user may extract another tissue when so desired.

Applicant's invention comprises a planer partition 28 positioned below fresh tissues 20 within tissue container 12. Planer partition 28 is substantially identical in cross sectional area with the cross sectional area of tissue container 12 and divides tissue container 12 into two compartments as can best be seen with reference to FIG. 4. In applicant's invention, lower surface 16 of tissue container 12 contains an aperture 30 similar to aperture 22 in upper surface 14. Aperture 30 has secured to it a plastic receptacle bag 32 which is secured about the circumference of aperture 30 and provides for a plastic flap 34 and slit 36 through aperture 30. Aperture 30 and slit 36 in plastic receptacle bag 32 provides for a receptacle area for the storing of waste tissues.

Figure 4:
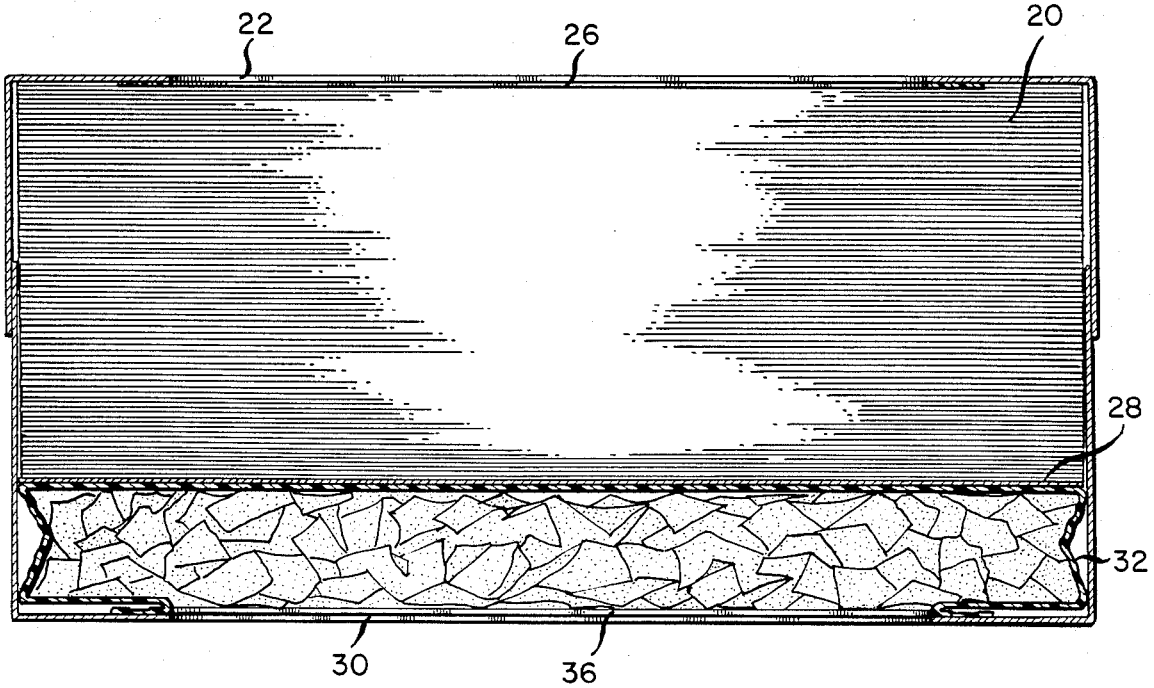
FIG. 4 is a side elevational cutaway view of the tissue box and waste receptacle along axis 4—4.

FIG. 4 is a side elevational cutaway view of tissue container 12 showing receptacle 32 partially filled with waste tissue.

When the package or tissue container 12 is initially opened, plastic receptacle bag 32 is in a substantially collapsed state beneath planer dividing wall 28. Tissue container 12 is substantially filled with fresh tissues As the tissues are extracted from aperture 22 through slit 26 and utilized, if no waste container is readily available, the user may insert the used or soiled tissue into plastic receptacle bag 32 by means of slit 36. Plastic receptacle bag 32 in conjunction with flaps 34 which cooperate with aperture 30 maintain the soiled tissues in an enclosed environment and further maintain the soiled tissues in an environment separate, distinct and segregated from the fresh tissues in the container 12.

As fresh tissues 20 are used and soiled, they are disposed of in plastic receptacle bag 32 such that plastic receptacle bag 32 is able to expand beneath dividing wall 28 while the supply of fresh tissues 20 above dividing wall 28 is depleted through use.

Figure 1:
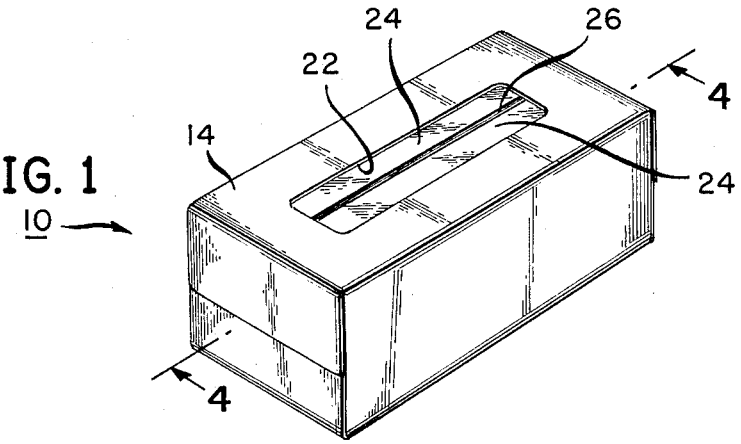
FIG. 1 is a top perspective view of the tissue box.
Figure 2:
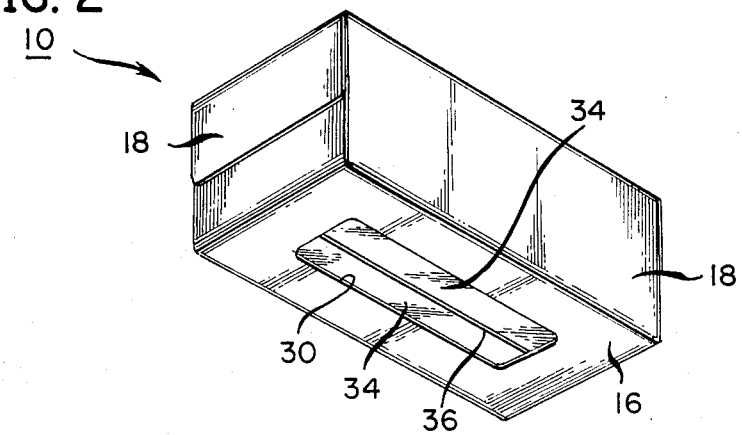
FIG. 2 is a bottom perspective view of the tissue box.

FIG. 4 is a side elevational view of the tissue box 10 showing it partially depleted of fresh tissues and the storage of soiled tissues. FIGS. 1 and 2 are top and bottom perspective views of the tissue box.

Applicant's invention provides for a novel and economical manner of disposing of soiled tissues when no other waste receptacle is readily available. While the present invention is disclosed with respect to a standard tissue box, its application can be directed toward any portable container designed to dispense disposable tissues such as those designed to dispense pre-moistened towelettes. While the present invention has been described in connection with the exemplary embodiment thereof, it will be understood that many modifications will be apparent to those of ordinary skill in the art; and that this application is intended to cover any adaptations or variation thereof. Therefore, it is manifestly intended that this invention be only limited by the claims and the equivalence thereof.

I claim:

1. A receptacle for the selective removal of tissues and storage of soiled tissues comprising an enclosed container having opposing first and second surfaces with said opposing surfaces being secured together by a circumferential sidewall, said first opposing surface having an aperture therethrough;

a movable partition disposed in said container, said movable partition substantially parallel to said first and second opposing surfaces;

a plurality of unused tissues disposed between said movable partition and said first opposing surface, said tissues selectively removable through said aperture of said first surface;

an expandable receptacle positioned between said movable partition and said second opposing surface, said expandable receptacle comprising a plastic envelope, said plastic envelope having a longitudinal aperture slit coincident with a longitudinal aperture positioned in said second opposing surface, said plastic envelope and said longitudinal aperture providing a deformable seal, for receipt of soiled tissues, said expandable plastic envelope, expanding to occupy the void left from the depletion of unused tissues, said soiled tissues being positioned within said expandable plastic bag receptacle, through said deformable seal, said soiled tissues thereby disposing said movable partition towards said first opposing surface for the further selective removal of unused tissues.

* * * * *